US009702102B2

(12) United States Patent
Reinhold et al.

(10) Patent No.: US 9,702,102 B2
(45) Date of Patent: Jul. 11, 2017

(54) CLEANING DEVICE FOR CLEANING ARTIFICIAL FLOOR AREAS PROVIDED WITH FLOOR COVERING PARTICLES, ESPECIALLY FOR ARTIFICIAL TURF

(75) Inventors: Schmid Reinhold, Asselfingen (DE); Vrbanic Andre, Heidestrabe (DE)

(73) Assignee: WIEDENMANN GMBH, Ulm (DE)

( * ) Notice: Subject to any disclaimer, the term of this patent is extended or adjusted under 35 U.S.C. 154(b) by 1182 days.

(21) Appl. No.: 13/599,515

(22) Filed: Aug. 30, 2012

(65) Prior Publication Data

US 2013/0055524 A1 Mar. 7, 2013

(30) Foreign Application Priority Data

Sep. 7, 2011 (DE) ..... 10 2011 082 311

(51) Int. Cl.
*E01H 1/08* (2006.01)
*A47L 11/40* (2006.01)

(52) U.S. Cl.
CPC ..... *E01H 1/0845* (2013.01); *A47L 11/4027* (2013.01)

(58) Field of Classification Search
CPC ..... E01H 1/845
USPC ..... 15/345, 347, 353, 352
See application file for complete search history.

(56) References Cited

U.S. PATENT DOCUMENTS 1,369,118 A * 2/1921 McDougall et al. ..... 15/356
3,505,703 A * 4/1970 Miller ..... E01H 1/0845 15/340.1
3,521,436 A * 7/1970 Venzke ..... A01D 43/063 15/79.2
3,540,073 A * 11/1970 Issenmann ..... E01H 1/0845 15/340.1

(Continued)

FOREIGN PATENT DOCUMENTS

DE 4408247 A1 * 9/1995 ..... A47L 11/22
EP 1 080 275 B2 10/2006

(Continued)

OTHER PUBLICATIONS

Office Action of the corresponding German Patent Application No. 10 2011 082 311.5, dated May 14, 2012.

*Primary Examiner* — Joseph J Hail
*Assistant Examiner* — Arman Milanian
(74) *Attorney, Agent, or Firm* — Global IP Counselors, LLP

(57) ABSTRACT

A cleaning device for cleaning artificial floor coverings provided with floor covering particles, such as artificial turf, comprising a sweeping device for gathering dirt particles from the floor covering, a separation device for separating the dirt particles from floor covering particles, a floor covering particle feedback device for gathering the floor covering particles separated from the dirt particles and feeding back the floor covering particles to the floor, a filter device for filtering dust particles, and a suction device which draws air from the area of the separation device through the (Continued)

filter device. First and second negative-pressure chambers in which negative pressure can be formed by the suction device suction are formed above and below the separation device, respectively, in fluid communication through the separation device. The first negative-pressure chamber is in fluid communication with the suction device only via the second negative-pressure chamber.

20 Claims, 5 Drawing Sheets

(56) References Cited

U.S. PATENT DOCUMENTS 3,639,940 A * 2/1972 Carlson ..... A47L 9/20 15/340.3
3,902,219 A * 9/1975 Jones ..... 15/314
4,006,511 A * 2/1977 Larsen ..... E01H 1/0845 15/340.3
4,110,864 A * 9/1978 Gunnarsson ..... 15/346
4,457,043 A * 7/1984 Oeberg ..... A47L 9/08 15/340.1
5,303,448 A * 4/1994 Hennessey et al. ..... 15/340.3
5,562,779 A * 10/1996 Allaway et al. ..... 134/10
5,848,521 A * 12/1998 Kobayashi ..... A01G 1/125 15/340.4
5,943,733 A * 8/1999 Tagliaferri ..... 15/340.4
6,070,290 A * 6/2000 Schwarze ..... A01B 45/00 15/340.1
6,195,837 B1 * 3/2001 Vanderlinden ..... E01H 1/042 15/340.3
8,020,250 B2 * 9/2011 de Bree ..... 15/346
2003/0037388 A1 * 2/2003 Feyma ..... E01H 1/0854 15/79.2
2005/0044656 A1 * 3/2005 Prevost ..... 15/345
2006/0282965 A1 * 12/2006 Basham ..... A47L 11/24 15/52.1
2010/0037419 A1 * 2/2010 de Bree ..... E01H 1/0854 15/347
2012/0298136 A1 * 11/2012 De Bree ..... E01H 1/0854 134/6

FOREIGN PATENT DOCUMENTS

WO WO-2006/046863 A1 5/2006
WO WO2008/060145 A1 5/2008

* cited by examiner

CLEANING DEVICE FOR CLEANING ARTIFICIAL FLOOR AREAS PROVIDED WITH FLOOR COVERING PARTICLES, ESPECIALLY FOR ARTIFICIAL TURF

The invention relates to a cleaning device for cleaning artificial floor coverings provided with floor covering particles, such as, in particular, artificial turf.

Due to the continuous improvement in the development of artificial turf, artificial turf is used more and more as a sports floor covering. Conventional artificial turf consists of an underlayer of various materials into which the blades of grass manufactured from plastic are embedded. Floor covering particles are used as fillers in artificial turf. Usually, a first layer of sand is disposed between the blades of grass, over which a layer consisting of a granulate, e.g. plastic granulate or rubber granulate, is disposed. A variety of examples of different types of artificial turf can be found in the patent literature; merely by way of example, mention is made of EP 1 080 275 B2.

Artificial turf is laid, for example, in dry regions as a playing surface, for example on soccer fields. During sporting activities, the artificial turf is exposed to corresponding stress, with dirt also accumulating. Therefore, the artificial turf also has to be cleaned. Apart from manual cleaning, there is also cleaning by means of machines. Machines are available on the market for this purpose which sweep over the turf with brushes, for example plastic brushes. The dirt particles are stirred up in the process. The problem in this case is that the floor covering particles, such as sand particles or granulate particles, which are used for forming the artificial turf, are also stirred up. They are supposed to be put back on the turf when the artificial turf is being cleaned. Therefore, cleaning devices are already known in the prior art in which all of the particles are fed through a separation device. The separation device comprises a screen for separating the floor covering particles from the dirt particles, with the floor covering particles then being supposed to be fed back onto the cleaned floor area. The coarser dirt particles adhere to the screen and are disposed of.

Examples for known cleaning devices for cleaning artificial turf are disclosed in WO 2006/046863 A1 and WO 2008/060145 A1.

The device known from WO 2008/060145 A1 additionally comprises a suction device with which smaller dust particles are supposed to also be removed by suction.

A considerable quantity of dust is produced when the artificial turf is being cleaned, in particular in dry regions, which is supposed to be handled by the device from WO 2008/060145 A1. However, dust removal is only insufficient; and the separating action is affected to a considerable extent by the known suction process. Therefore, the efficiency factor is very much subject to improvement.

It is the object of the invention to provide a cleaning device which is improved over cleaning devices known so far with regard to the handling of dust—particularly dust removal—, cleaning action and feedback of floor covering particles. This object is achieved with a cleaning device having the features of claim 1.

Advantageous embodiments of the invention are the subject matter of the dependent claims.

The invention provides a cleaning device for cleaning artificial floor coverings provided with floor covering particles, in particular artificial turf, comprising:

a sweeping device for gathering dirt particles from the floor covering, a separation device for separating the dirt particles from floor covering particles, a floor covering particle feedback device preferably configured for gathering the floor covering particles separated from the dirt particles by the separation device, and in particular for feeding back the floor covering particles to the floor, a filter device for filtering dust particles, and a suction device which draws air from the area of the separation device through the filter device, wherein the cleaning device comprises a first negative-pressure chamber and a second negative-pressure chamber, in which a negative pressure can be formed by the suction of the suction device, the first negative-pressure chamber being formed above the separation device, wherein the first and the second negative-pressure chambers are in fluid communication through the separation device, wherein the second negative-pressure chamber is formed below the separation device, and wherein the first negative-pressure chamber is in fluid communication with the suction device only via the second negative-pressure chamber, in order to draw air from the second negative-pressure chamber by means of the suction device and to draw air from the first negative-pressure chamber via the second negative-pressure chamber.

It is preferably provided that the first and the second negative-pressure chambers are interconnected by a bypass duct in order to draw air through the bypass duct past the separation device from the first negative-pressure chamber into the second negative-pressure chamber and into the suction device.

It is particularly preferred that a third negative-pressure chamber is provided, wherein the suction device leads into the third negative-pressure chamber, wherein the second negative-pressure chamber is in fluid communication with the suction device via the third negative-pressure chamber, wherein the filter device is interposed between the second and the third negative-pressure chambers, so that air drawn from the second negative-pressure chamber into the third negative-pressure chamber flows through the filter device for filtering out dust.

According to one embodiment of the invention, it is provided that the filter device comprises a cyclone filter.

It is preferred that the separation device comprises an upper coarser screen for separating dirt particles that are larger compared to the floor covering particles and a lower finer screen for separating the floor covering particles from dirt particles that are smaller compared to the floor covering particles, wherein the floor covering particles can be transferred from the intermediate space between the screens to the floor covering particle feedback device.

It is particularly preferred that the suction device draws air from the first negative-pressure chamber at least partially through the upper and through the lower screen via the second negative-pressure chamber and via the filter device.

In the cleaning device according to the invention, the dust particles are not drawn off, as known in the prior art, from above, but at least partially through the separation device. Different negative-pressure areas that are in fluid communication with one another are created within the cleaning device. Thus, a first negative-pressure chamber formed above the separation device is in fluid communication with a second negative-pressure chamber formed below the separation device. Preferably, air of the first negative-pressure chamber is drawn off via the second negative-pressure chamber. This is done at least partially through the separation device.

Thus, the separation device as a whole is situated in a negative-pressure area, so that dust produced during separation is also drawn off well.

A drawing-off process, at least partially through the separation device, is moreover capable of supporting the separating process because the floor covering particles are pulled towards the separation device and not, as is the case in the prior art, drawn away from the separation device by the suction.

In a preferred embodiment of the invention, a bypass is moreover provided, so that only a part of the suction is routed through the separation device. Depending on the provision of the bypass duct, the application of suction to the separation device can thus be adjusted in order to achieve in this way an optimal relationship between the support by suction and the avoidance of floor particles adhering to the separation device due to a suction that is too large.

It is preferably provided that a transport duct for transporting the particles from the sweeping device to the separation device is provided. The particles can be conducted from the bottom upwards onto the separation device through the transport duct, in order thus to carry out an effective separation.

Preferably, the transport duct has at least one bend. With advantageous bends, flows can be optimized and a pre-separation can already be achieved by different centrifugal force effects.

It is furthermore preferred that the transport duct at the separation device comprises an inlet section directed towards the separation device, and that the bypass duct is disposed adjacent to the inlet section and, with at least one directional component, is oriented in an opposite direction to a directional component of the inlet section. The particles can be conducted towards the separation device through the inlet section. For example, a particle-air flow can be conducted from the transport duct towards a screen device so that air continues to flow through the screen device and particles of different sizes are separated at the screen device. The bypass duct, preferably adjacent to the inlet section, leads out of the first negative-pressure chamber. Preferably, the directions of the bypass duct and of the inlet section are at an acute angle relative to each other, so that air from the inlet section has to take a sharp turn in order to flow out through the bypass duct. Heavy particles do not follow such a reversal of direction, lighter ones do. Floor covering particles and larger dirt particles can also be conducted towards the separation device in this manner, whereas light dust particles can also be drawn off through the bypass duct.

In a particularly preferred embodiment, the cleaning device comprises a cyclone filter as a filter device. Cyclone filters of this type are known in principle from other fields; such cyclone filters possess a particularly good dust removal action.

In order to support the action of the cyclone filter, it is further preferably provided that a different negative-pressure area is respectively provided upstream and downstream of the cyclone filter. For example, a third negative-pressure chamber can be provided which is evacuated by suction by means of the suctioning device. The air then preferably flows from the first negative-pressure chamber, at least partially, via the separation device to the second negative-pressure chamber, then completely via the filter device to the third negative-pressure chamber, whence the air is drawn off via the suctioning device, which can comprise a fan, for example.

According to an advantageous embodiment of the invention, it is furthermore preferred that the separation device is configured both for separating larger dirt particles whose particle size exceeds the size of the floor covering particles to be fed back, as well as for separating smaller dirt particles whose particle size is smaller than the particle size of the floor covering particles to be fed back.

For this purpose, the separation device preferably comprises a coarser screen and a finer screen, with the floor covering particles accumulating between the two screens and being fed back from there.

The separation device is preferably configured as a screen device. In particular—as is already known in principle in the prior art—a shaker device or other vibrating device for applying vibration energy to the separation device can also be provided here.

The separation device preferably comprises at least one screen configured in an inclined manner. If, for example, vibrations are applied to the screen, particles captured on the screen are thus shaken towards a lower side of the screen and carried away there.

Therefore, a coarser screen can be an upper screen, for example, which is inclined to be slightly lower on one side and which ends, for example, above a first collecting device for collecting coarser dirt particles. The coarser dirt particles can then be discharged into the first collecting device.

The finer screen is preferably a lower screen which is disposed below the coarser screen, with the screen preferably ending above an admission opening of the floor covering particle feedback device.

The floor covering particle feedback device can be formed, in particular, by a discharging area in a central area of the cleaning device.

Preferably, a second collecting device for collecting smaller dirt particles is provided, which is disposed below the finer screen in order to collect the dirt particles falling through the finer screen in the event they have not already been filtered out by the filter device.

Thus, a drawing-off process is carried out at the screen device, wherein air is conducted through filters in order to remove dust.

Preferably, there is a dual screen for coarse dirt and medium dirt.

Further preferably, there is a suction device. The suction device preferably provides suction through both screens of the dual screen. Of course, a multiple screen with a number of screens other than two can be used instead of a dual screen.

The filter device preferably comprises at least one cyclone filter. One advantage of a cyclone filter is a particularly high efficiency factor. Even smaller dusts can be removed reliably. In addition, such cyclone filters are insensitive even to damper weather. Dust-dry agglomerates can be separated as well as agglomerates with a higher air humidity with a corresponding wetting of the dusts.

A special feature in the cleaning device according to the invention is the provision of a negative-pressure zone in the device.

One preferred approach is to provide at least two substantially enclosed spaces in order thus to define a negative-pressure area and a high suction force. Preferably, a drawing-off process between two enclosed spaces is carried out through the cyclone filter.

In a preferred embodiment, an enclosed area with negative pressure is formed by an infeed chamber which seals the negative-pressure area towards the bottom, a transport duct for the particle-charged air, and a space above and below the separation device.

Preferably, the space above the separation device forms the first negative-pressure chamber, with this space preferably being separated from the open area of the cleaning device by a gap through which dirt can be transported onwards, for example to a dirt collecting device. The gap can be defined by a panel, for example, which extends up to the separation device. Due to the narrowed portion provided by the gap, negative pressure can be generated by means of the suction of the suctioning device even if the gap for passing dirt is open.

The area below the separation device which preferably forms the second negative-pressure chamber is preferably sealed off by means of a seal. Due to the sealing of the second negative-pressure chamber, to which the suction of the suctioning device is applied in turn, negative pressure is generated in both the second negative-pressure chamber and the first negative-pressure chamber, i.e. both above and below the separation device. Thus, dust is reliably drawn off from the separation device. Negative-pressure zones with different pressures can be obtained in this manner.

In another embodiment of the cleaning device, a negative-pressure chamber area is extended over the entire device, so that the entire device is put under negative pressure and dust is unable to escape the device.

Labyrinth seals or brushes, including rotating brush rollers, can be used instead of separating negative-pressure chambers by means of contact sealing strips, such as sealing profiles or rubber seals.

In one embodiment of the invention, for example, a rotating brush is provided on the separation device in order to forcibly convey particles adhering to the separation device away from the separation device. In one embodiment, these can be dirt particles that are conveyed onwards into a dirt particle collecting area. In another embodiment, these particles can also be the floor covering particles, which are conveyed onwards accordingly from the separation device in order to arrive back at the floor. Such an embodiment is advantageous particularly in cases where the second negative-pressure chamber situated below the separation device is extended further over the device, so that the suction may also lead to the particles adhering to the separation device too strongly or to them being otherwise retained too much in the negative-pressure area.

Labyrinth seals or appropriate discharge devices, for example rotating belts or rotating screens or belt screens, may provide a remedy for this.

The cleaning device is preferably configured as a mobile device. For this purpose, the cleaning device comprises a chassis and/or a housing provided with a running gear for traveling over the floor.

In one possible embodiment, the cleaning device is configured as a self-propelled device; another possible embodiment is configured as a device that can be connected to a towing vehicle, e.g. as a trailer for a tractor or the like. Of course, the device can also be configured as an attachment for a utility vehicle, be it in the front area, the central area or the rear area. Another option is that the device can be pulled over the artificial turf by a person.

In the exemplary embodiment which is explained in more detail below with reference to the drawings, the device is configured, for example, as a trailing device with corresponding wheels. The suctioning device comprises a fan. The sweeping device preferably comprises a brush roller. A motor, for example an internal combustion engine or an electric motor, is preferably provided which is capable of driving the various systems of the cleaning device. Thus, the brush roller, the fan and/or a vibrating screen, for example, can be driven by a motor.

In an alternative embodiment which is not shown in more detail, a power take-off drive is provided which can be connected to a power take-off shaft of a towing vehicle or of a tractor.

An exemplary embodiment of the invention will be explained below with reference to the attached drawings. In the figures:

FIGS. 1-6 show different views of a cleaning device 10 for cleaning artificial turf.

Figure 1:
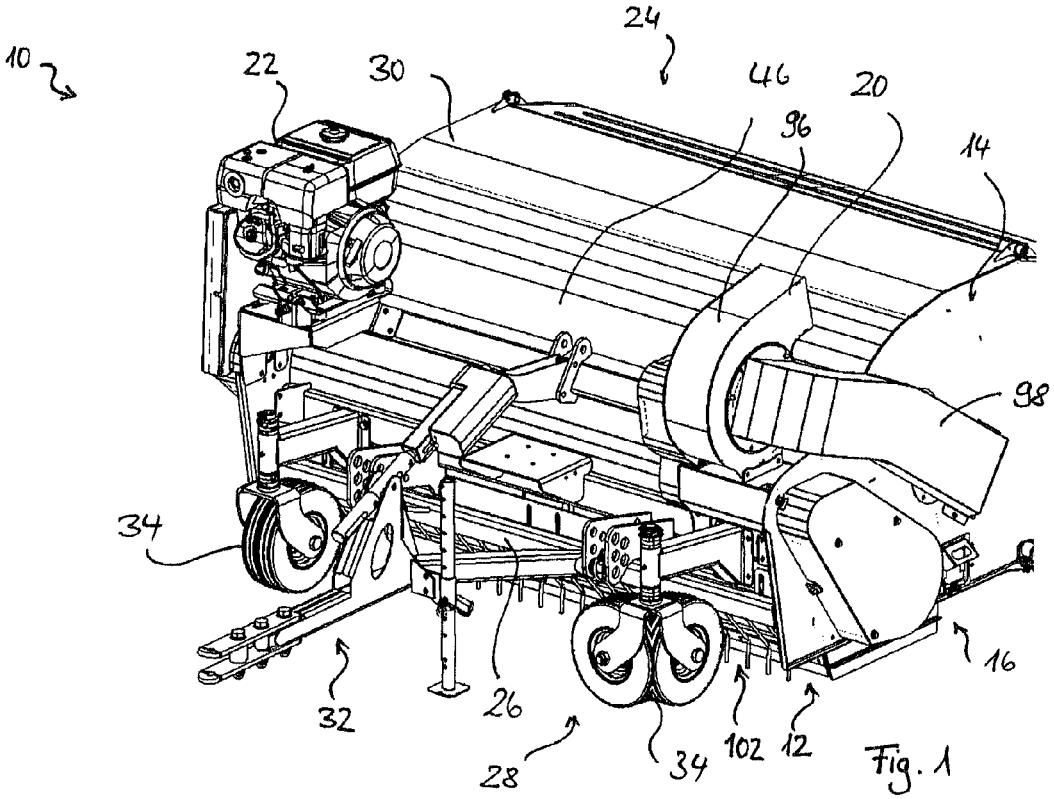
FIG. 1 shows a perspective view of a cleaning device for cleaning artificial turf.
Figure 2:
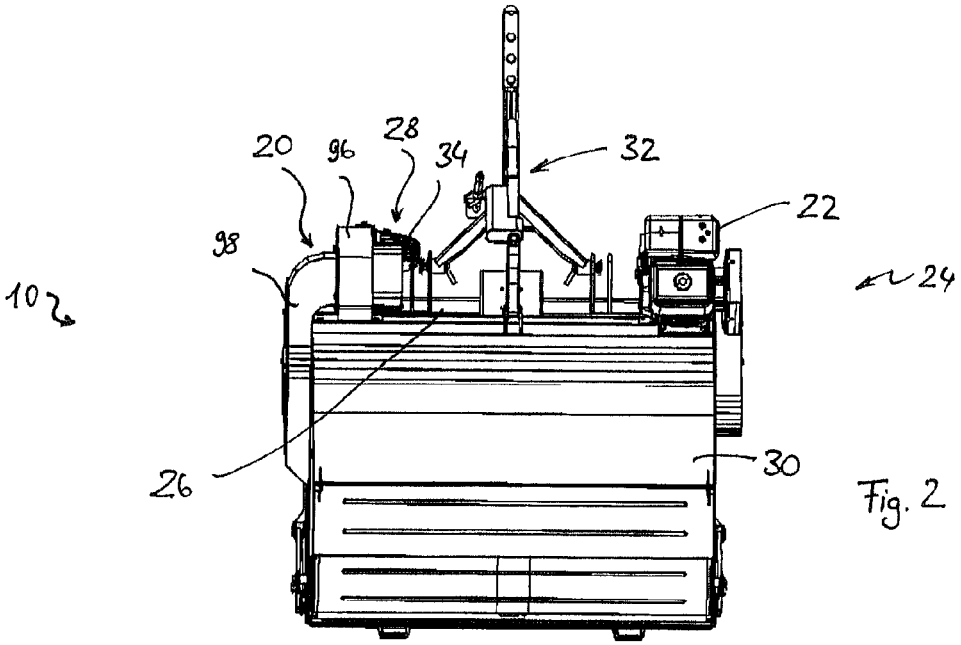
FIG. 2 shows a top view onto the cleaning device of FIG. 1.

The cleaning device 10 comprises a sweeping device 12, a separation device 14, a floor covering particle feedback device 16, a filter device 18 and a suction device 20. Furthermore, the cleaning device comprises a motor 22 for driving the devices.

The exemplary embodiment of the cleaning device 10 shown is configured as a mobile cleaning unit 24 that can be hooked up to a vehicle (not shown). The cleaning device 10 comprises a device frame 26, a running gear 28 and a housing 30.

A hook-up device 32 is attached to the device frame 26 for hooking it up to the towing vehicle.

The running gear 28 comprises castors 34 that are rotatable about a vertical axis and wheels 36, so that the cleaning device 10 can be driven over a floor area to be cleaned. In a further embodiment which is not shown in more detail, the cleaning device 10 is configured as a self-propelled device, wherein the wheels 36 can be driven by the motor 22.

The sweeping device 12 is configured for gathering dirt particles from the floor covering to be cleaned. In the example shown here, it comprises a brush roller 40 that can be driven by the motor 22.

In the example shown, the brush roller 40 is disposed between the castors 34 and the wheels 36 and comprises bristles 42 which, when rotating over the artificial turf with artificial blades, can swipe floor covering particles between them in order to straighten up, freshen up and clean the artificial turf.

Figure 5:
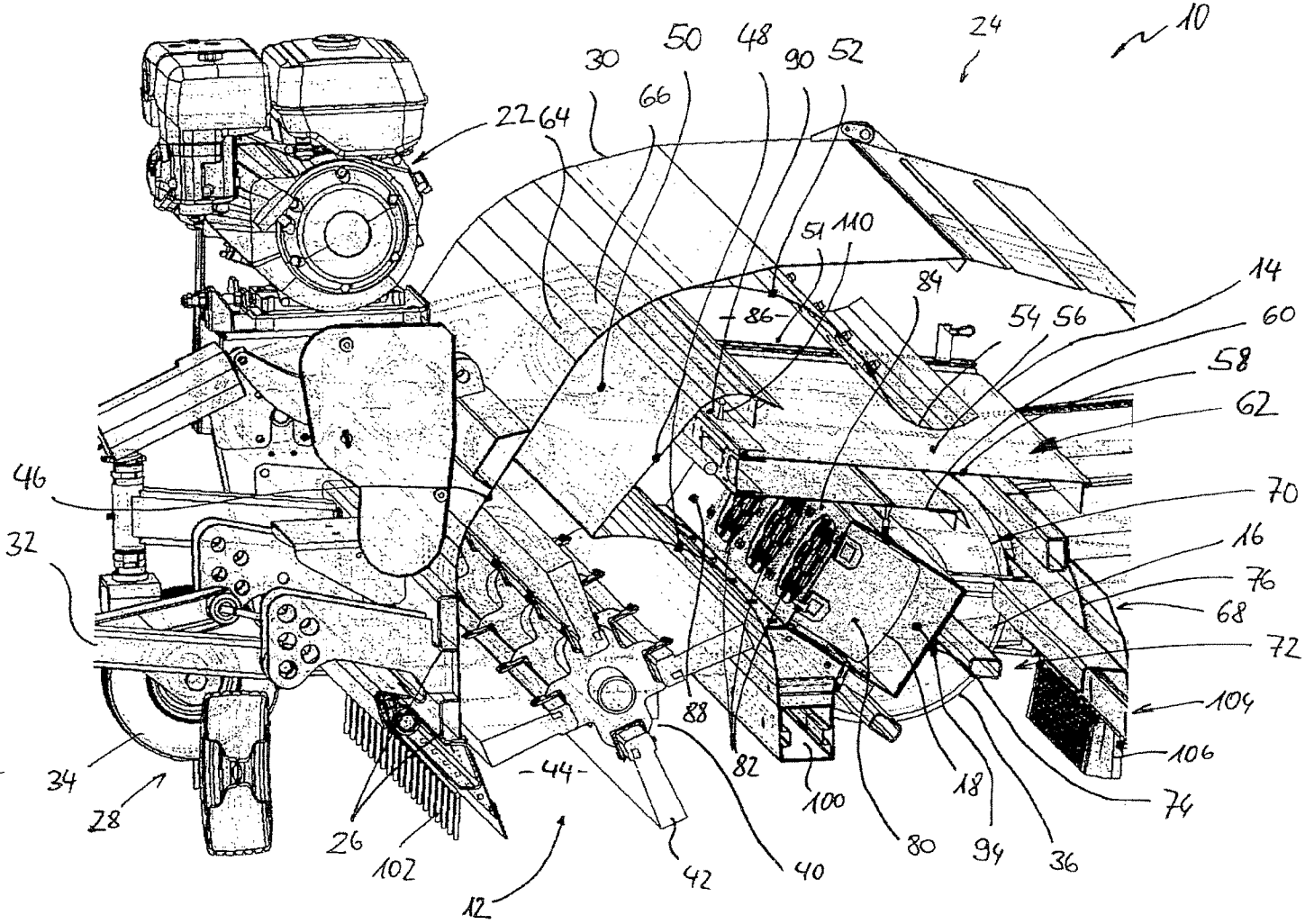
FIG. 5 shows another view, shown in a partial section, of the cleaning unit, from which internal elements are more clearly apparent.
Figure 6:
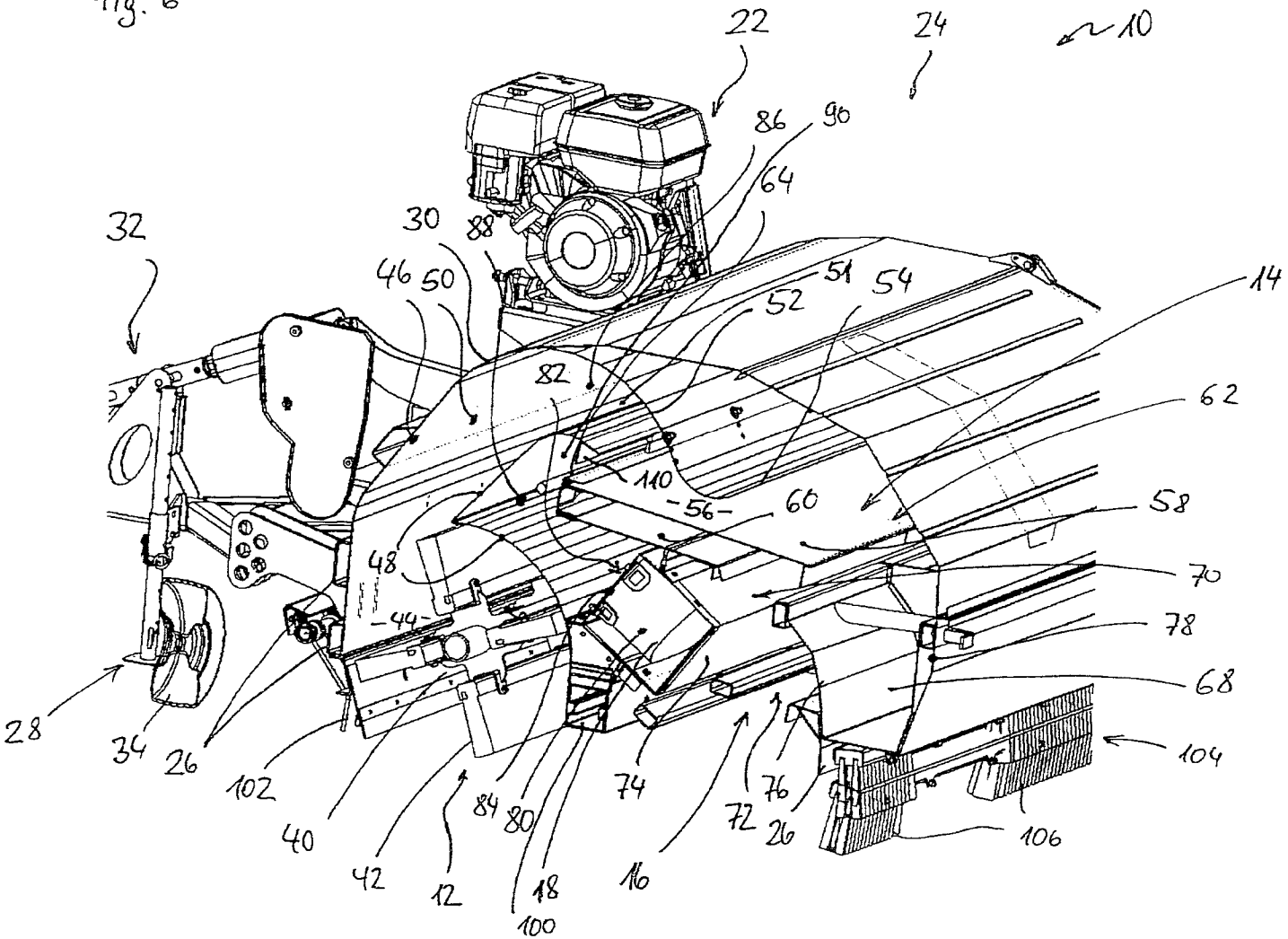
FIG. 6 shows another view, shown in a partial section and partially in perspective, of the cleaning device.

As can best be seen in FIGS. 5 and 6, the brush roller 40 is formed in an infeed chamber 44 which is open towards the bottom and which is delimited, on the one hand, by a front housing wall 46 and, on the other hand, by a transverse partition 48. In the illustrations of FIGS. 5 and 6, the brush roller 40 is driven to rotate in such a manner that the brushes at the bottom swipe over the artificial turf in a direction opposite to the driving direction and are brought up at the front of the brush roller 40.

A transport duct 50 for transporting material gathered up by the sweeping device towards the separation device 14 is formed above the area of the brush roller that rotates upwards.

For example, the transport duct 50 is also delimited by the housing wall 46 and a corresponding upwardly extending appendage of the transverse partition 48. The transport duct 50 leads upwards from the infeed chamber 44 and is then further delimited, in an upper area of the cleaning device, by an upper partition 52, which partition is curved in an approximate S-shape. Thus, the transport duct 50 first extends upwards in an oblique manner and then takes a turn in a downward direction towards the separation device 14. The partition 42 is extended above the separation device 14 by an end portion, which is again curved upwards, wherein this curved end portion 54 defines a gap 56 between the separation device 14 and the partition 52. Thus, the transport duct ends in an inlet section that is directed obliquely downward and rearward towards the separation device 14.

The separation device 14 is configured for separating the particles gathered up by the sweeping device 12 into dirt particles, on the one hand, and floor covering particles, on the other hand.

In the example shown, the separation device 14 comprises a coarser screen 58 to which larger dirt particles adhere and through which smaller floor covering particles pass that are to be fed back to the floor.

The separation device 14 furthermore comprises a finer screen 60 which, with regard to its mesh size, is selected in such a way that floor covering particles that are to be fed back to the floor are retained and dirt particles and dust particles with a smaller particles size than the floor covering particles pass through.

Accordingly, the separation device 14 comprises a multiple screen, in particular a dual screen 62. The coarser screen 58 is preferably configured as an upper screen and the finer screen 60 is preferably configured as a lower screen.

The separation device 14 moreover comprises a vibration-generating device 64 with which the dual screen 62 can be made to vibrate. The vibration-generating device 64 comprises, for example, a rotating shaft 66 with eccentric members which is driven by the motor 22. With one end, the dual screen 62 is eccentrically mounted on the rotating shaft 66, with another end, which in this case is the rear end, seen in the driving direction, being disposed lower, so that the dual screen 62 is inclined in a rearward and downward direction.

The upper coarser screen 58 ends at this lower end above a first collecting container 68 for collecting coarser dirt particles.

The lower, finer screen 60 is configured to be shorter than the upper, coarser screen 58, and with its lower end ends above a receiving area 70 of the floor covering particle feedback device 16.

Thus, the floor covering particle feedback device 16 is configured for gathering the floor covering particles that have been separated from the dirt particles by the separation device 14, that pass through the coarser screen 58, and that have been retained by the finer screen 60, and moreover serves for feeding back the floor covering particles to the floor. For this purpose, the floor covering particle feedback device 16 comprises a feedback duct 72 which substantially extends transversely through the device and is open towards the bottom.

The feedback duct 72 is delimited towards the front by a front boundary wall 74 and towards the rear by a rear boundary wall 76. The rear boundary wall 76, for example, is a part of the first collecting container 68 whose rear area is delimited by a rear housing wall 78.

The filter device 18 serves for filtering dust particles. It is disposed in an area between the transverse partition 48 and the front boundary wall 74.

The filter device 18 comprises one or more cyclone filters 80. An entrance area of the cyclone filters 80 is located in a dividing wall 84 equipped with a filter entrance 82.

The dividing wall 84 extends between the transverse partition 48 and the front boundary wall 74 and thus subdivides the area between these walls into several chambers.

As a result, a first negative-pressure chamber 86 is thus formed which encloses the transport duct 50 with the transverse partition 58 and the upper partition 52 and an area above the separation device 14. Thus, the first negative-pressure chamber 86 is delimited by the boundaries of the transport duct 50, the gap 56 and the dividing wall 84.

A second negative-pressure chamber 88, which is in fluid communication with the first negative-pressure chamber 86 via the dual screen 62 and a bypass duct 90, is formed in the area in front of and below the separation device 14 and above the dividing wall 84. Otherwise, the second negative-pressure chamber 88 is sealed from a rear area of the device by means of seals 92.

The bypass duct 90, adjacent to the inlet section 51, leads out of the first negative-pressure chamber 86 in a direction towards the front. For example, the bypass duct 90 is formed below the inlet section 51. With regard to their horizontal directional components, the bypass duct 90 and the inlet section 51 are directed in opposite directions relative to one another, and form an acute angle between them. Air conducted through the inlet section 51 towards the separation device 14 can thus also be drawn off via the bypass duct 90. Lighter particles, such as dust, are capable of following the sharp change of direction and can be drawn off through the bypass duct 90; heavier particles, such as larger dirt particles and floor covering particles, however, immediately arrive at the separation device 14 due to their inertia.

A third negative-pressure chamber 94 is formed between the dividing wall 84 and the front boundary wall 74, with this third negative-pressure chamber 94 being in fluid communication with the second negative-pressure chamber 88 only via the filter device 18, and more precisely, via the cyclone filters 80. The suction device 20 is configured for drawing off air from the area of the separation device 14 through the filter device 18.

Figure 3:
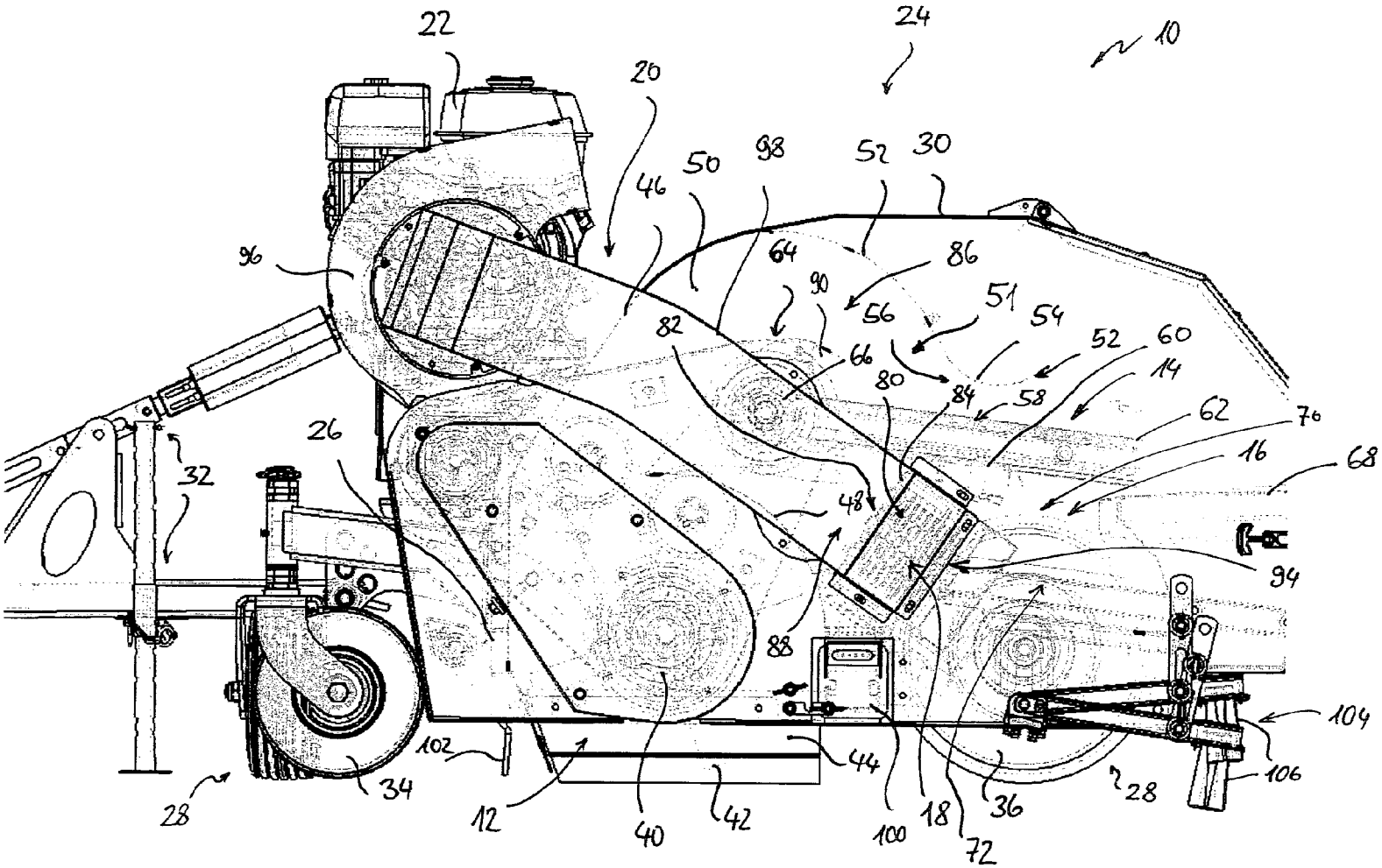
FIG. 3 shows a view of the right-hand side, with internal elements of the cleaning device being represented by dashed lines.
Figure 4:
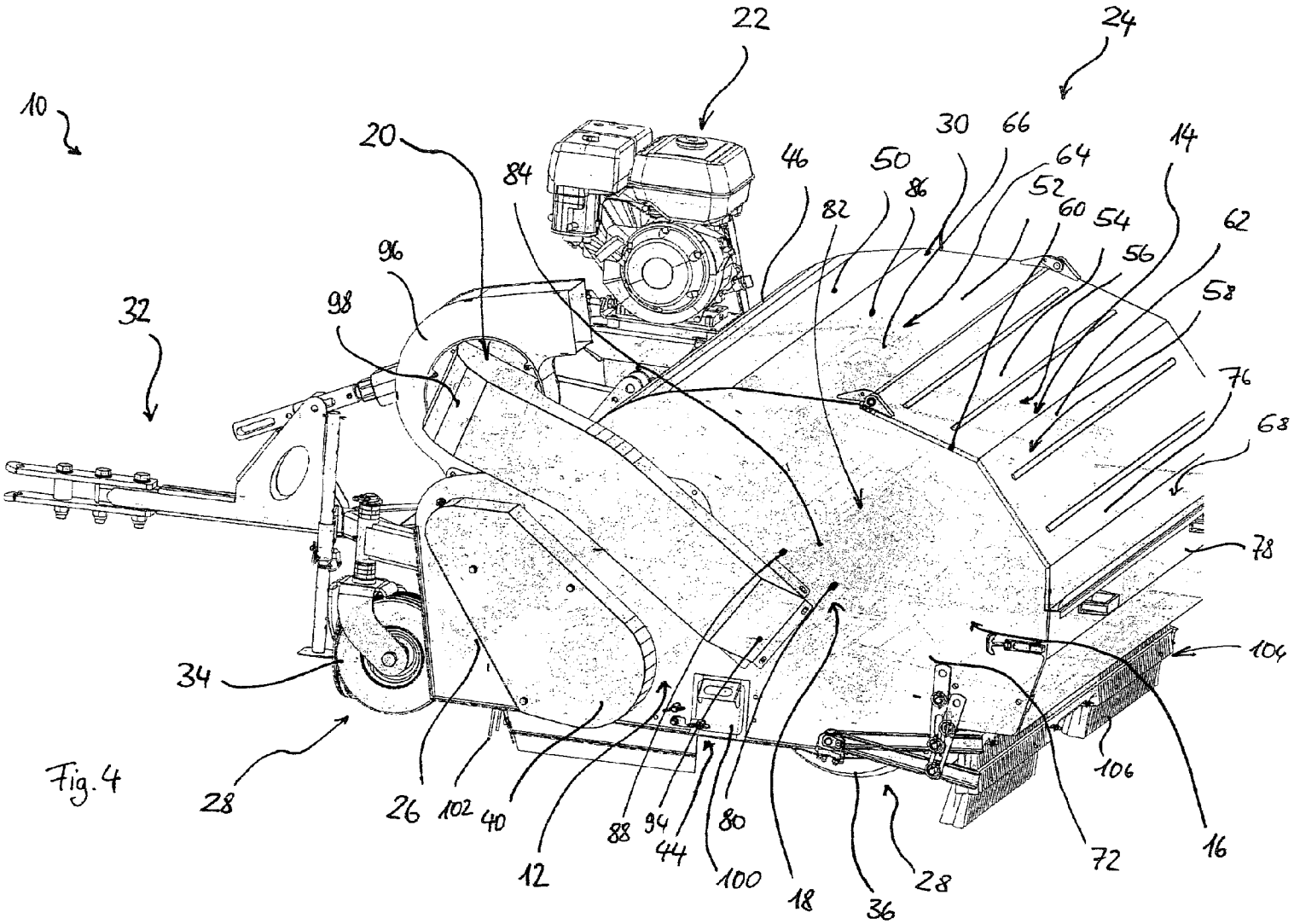
FIG. 4 shows a perspective side view from the right and the rear onto the cleaning device, with internal areas and elements being represented by dashed lines.

The suction device 20 can best be seen in FIG. 4 and FIG. 3. It comprises a fan 96, for example a radial fan, which is driven by the motor 22 and is connected to the third negative-pressure chamber 94 by means of a suctioning duct 98.

Thus, the fan 96 draws air through the suctioning duct 98 and generates a negative pressure in the third negative-pressure chamber, whereby air is in turn drawn out from the second negative-pressure chamber 88 through the filter device 18 towards the third negative-pressure chamber 94. The second negative-pressure chamber 88 is in fluid communication with the first negative-pressure chamber 86, in part via the separation device 14 and in part via the bypass duct 90, whereby a negative pressure is also generated in the first negative-pressure chamber 86. Dust particles captured by the cyclone filters 80 are collected in a second collecting container 100 located below the filter device 18.

Furthermore, an inlet comb 102 for aligning the artificial turf is provided at a front lower end portion of the cleaning device. Moreover, a brush assembly 104 comprising brushes 106 hinged to moveable supporting arms is provided on a rear lower end portion. A transport position—supporting arm and brushes 106 are pivoted upwards—and a working position—supporting arm and brushes 106 are pivoted downwards—are shown in the illustrations. The supporting arms can be manually moved between these end positions and locked in the end positions.

The function of the exemplary embodiment of the cleaning device 10 shown in FIGS. 1 through 6 will by explained below.

The cleaning device 10 is driven over the artificial turf (not shown) to be cleaned, with the motor 22 driving the brush roller 40 to rotate and causing the dual screen 62 to vibrate. Moreover, the fan 96 is driven by the motor 22 in order thus to generate a negative pressure in the negative-pressure chambers 86, 88, 94.

The artificial turf (not shown) is passed through the inlet comb 102 and the rotating brush roller 40 with its bristles 42 is applied to it. The rotation of the brush roller 40 generates a dynamic pressure in an upward direction within the transport duct 50, so that particles gathered by the brush roller 40 are conducted upwards through the transport duct 50 and then along the upper bend, and moved towards the separation device 14. Larger dirt particles become stuck on the coarser screen 58 and are transported through the gap 56 towards the rear into the first collecting container 68 by the vibrating motion. Floor covering particles and smaller dirt particles pass through the coarser screen 58, with this movement, as well as the entire particle transport, being additionally supported by the suction during the drawing process between the first negative-pressure chamber 86 and the second negative-pressure chamber 88. Suction is applied to the entire negative-pressure chambers 86, 88, 94 by the fan 96, so that dust particles are conducted through the finer screen 60 towards the filter device 18. The suction through the separation device 14 is set by the dimensions of the cross section of the bypass duct 90. For this purpose, the bypass duct 90 contains corresponding baffle members, such as, in particular, a brush strip 110 disposed at the upper curved area of the transverse partition 48. Moreover, a part of the air flowing in through the inlet section 51 is drawn off through the bypass duct 90, with smaller entrained dust particles, which are able to follow the change of direction between the inlet section 51 and the bypass duct 90 because of their low mass, also being drawn off. The power of the fan and the bypass duct 90 are set by the manufacturer in such a way that dust particles are reliably removed from the entire area of the separation device 14, but that the separating action of the separation device 14 is not substantially affected by adhering particles.

The floor covering particles to be fed back are retained by the finer screen 60 and transferred into the floor covering particle feedback device 16 by the vibrating action and conducted back onto the floor through the feedback duct 62. There, they are distributed into the artificial turf and disposed between the blades of grass by the brushes 106 of the brush assembly 104, and the artificial turf is again uniformly supplied with the floor covering particles.

The air from the second negative-pressure chamber 94 is transferred via the cyclone filters 80 into the third negative-pressure chamber 94, with the dust particles being separated in the process, and is discharged, freed from dust, via the suctioning duct 98 through the fan 96. The dirt and dust particles accumulating here are discharged into the second collecting container 100.

The collecting containers 68, 100 can be removed from the device for the purpose of emptying them, in order thus to dispose of the dirt.

LIST OF REFERENCE NUMERALS

10 Cleaning device
12 Sweeping device
14 Separation device
16 Floor covering particle feedback device
18 Filter device
20 Suction device
22 Motor
24 Cleaning unit
26 Device frame
28 Running gear
30 Housing
32 Hook-up device
34 Castors
36 Wheels
40 Brush roller
42 Bristles
44 Infeed chamber
46 Housing wall
48 Transverse partition
50 Transport duct
51 Inlet section
52 Partition
54 Curved end portion
56 Gap
58 Coarser screen
60 Finer screen
62 Dual screen
64 Vibration-generating device
66 Rotating shaft
68 First collecting container
70 Receiving area
72 Feedback duct
74 Front boundary wall
76 Rear boundary wall
78 Rear housing wall
80 Cyclone filter
82 Filter entrance
84 Dividing wall
86 First negative-pressure chamber
88 Second negative-pressure chamber
90 Bypass duct
92 Seal
94 Third negative-pressure chamber
96 Fan
98 Suctioning duct
100 Second collecting container
102 Inlet comb
104 Brush assembly
106 Brushes
110 Brush strip

The invention claimed is:

1. A cleaning device for cleaning artificial floor coverings provided with floor covering particles, comprising:

a sweeping device configured to gather dirt particles and floor covering particles from the floor covering;

a separation device configured to separate the dirt particles from the floor covering particles gathered by the sweeping device;

a filter device configured to filter dust particles;

a suction device configured to draw air from the area of the separation device through the filter device;

a first negative-pressure chamber and a second negative-pressure chamber, in which a negative pressure is formed by the suction of the suction device, the first negative-pressure chamber being formed above the separation device;

the first and the second negative-pressure chambers being in fluid communication through the separation device;

the second negative-pressure chamber being formed below the separation device, and a passage to the suction device defines an inlet which opens into the second negative-pressure chamber at a location below the separation device; and the first negative-pressure chamber being in fluid communication with the suction device through the second negative-pressure chamber such that the suction device is configured to draw air from the first negative-pressure chamber through the separation device into the second negative-pressure chamber to collect the floor covering particles separated from the dirt particles in the separation device; and a floor covering particle feedback device configured to feed back to the floor the floor covering particles collected in the separation device.

2. A cleaning device according to claim 1, wherein the first and the second negative-pressure chambers are interconnected by a bypass duct to draw air through the bypass duct to avoid passing through the separation device from the first negative-pressure chamber into the second negative-pressure chamber and into the suction device.

3. A cleaning device according to claim 1, further comprising a transport duct configured to transport the particles from the sweeping device to the separation device.

4. A cleaning device according to claim 3, further comprising a bypass duct, at the separation device, comprising an inlet section that is directed towards the separation device; and wherein the transport duct is disposed adjacent to the inlet section and, with at least one directional component, is oriented in an opposite direction to a directional component of the inlet section.

5. A cleaning device according to claim 1, further comprising a third negative-pressure chamber configured such that the suction device leads into the third negative-pressure chamber, the second negative-pressure chamber being in fluid communication with the suction device via the third negative-pressure chamber, and the filter device being interposed between the second and the third negative-pressure chambers so that air drawn from the second negative-pressure chamber into the third negative-pressure chamber flows through the filter device to filter out dust.

6. A cleaning device according to claim 1, wherein the filter device comprises at least one cyclone filter.

7. A cleaning device according to claim 1, wherein the separation device comprises an upper coarser screen configured to separate dirt particles that are larger compared to the floor covering particles and a lower finer screen configured to separate the floor covering particles from dirt or dust particles that are smaller compared to the floor covering particles, such that the floor covering particles can be transferred from the intermediate space between the screens to the floor covering particle feedback device.

8. A cleaning device according to claim 7, wherein the suction device is configured to draw air from the first negative-pressure chamber at least partially through the upper and through the lower screen via the second negative-pressure chamber and via the filter device.

9. A cleaning device according to claim 2, further comprising a transport duct configured to transport the particles from the sweeping device to the separation device.

10. A cleaning device according to claim 9, wherein the bypass duct, at the separation device, comprises an inlet section that is directed towards the separation device; and the transport duct is disposed adjacent to the inlet section and, with at least one directional component, is oriented in an opposite direction to a directional component of the inlet section.

11. A cleaning device according to claim 2, further comprising a third negative-pressure chamber configured such that the suction device leads into the third negative-pressure chamber, the second negative-pressure chamber being in fluid communication with the suction device via the third negative-pressure chamber, and the filter device being interposed between the second and the third negative-pressure chambers so that air drawn from the second negative-pressure chamber into the third negative-pressure chamber flows through the filter device to filter out dust.

12. A cleaning device according to claim 3, further comprising a third negative-pressure chamber configured such that the suction device leads into the third negative-pressure chamber, the second negative-pressure chamber being in fluid communication with the suction device via the third negative-pressure chamber, and the filter device being interposed between the second and the third negative-pressure chambers so that air drawn from the second negative-pressure chamber into the third negative-pressure chamber flows through the filter device to filter out dust.

13. A cleaning device according to claim 4, further comprising a third negative-pressure chamber configured such that the suction device leads into the third negative-pressure chamber, the second negative-pressure chamber being in fluid communication with the suction device via the third negative-pressure chamber, and the filter device being interposed between the second and the third negative-pressure chambers so that air drawn from the second negative-pressure chamber into the third negative-pressure chamber flows through the filter device to filter out dust.

14. A cleaning device according to claim 1, wherein the floor covering particle feedback device comprises a feedback duct that communicates with the separation device apart from the second negative-pressure chamber to feed back to the floor the floor covering particles collected in the separation device.

15. A cleaning device according to claim 1, wherein the separation device is angled downward toward the floor covering particle feedback device and comprises a vibration generating device configured to vibrate the separation filter to move the floor covering particles collected in the separation device toward the floor covering particle feedback device.

16. A cleaning device according to claim 2, further comprising a brush strip positioned between the separation device and the bypass duct.

17. A cleaning device according to claim 7, wherein the lower finer screen comprises an open edge in communication with the floor covering particle feedback device to pass the floor covering particles from the intermediate space between the screens to the floor covering particle feedback device.

18. A cleaning device according to claim 2, wherein the separation device comprises an upper coarser screen configured to separate dirt particles that are larger compared to the floor covering particles and a lower finer screen configured to separate the floor covering particles from dirt or dust particles that are smaller compared to the floor covering particles, such that the floor covering particles can be transferred from the intermediate space between the screens to the floor covering particle feedback device.

19. A cleaning device according to claim 3, wherein the separation device comprises an upper coarser screen configured to separate dirt particles that are larger compared to the floor covering particles and a lower finer screen configured to separate the floor covering particles from dirt or dust particles that are smaller compared to the floor covering particles, such that the floor covering particles can be transferred from the intermediate space between the screens to the floor covering particle feedback device.

20. A cleaning device according to claim 4, wherein the separation device comprises an upper coarser screen configured to separate dirt particles that are larger compared to the floor covering particles and a lower finer screen configured to separate the floor covering particles from dirt or dust particles that are smaller compared to the floor covering particles, such that the floor covering particles can be transferred from the intermediate space between the screens to the floor covering particle feedback device.

* * * * *